US009175575B2

(12) United States Patent
Simpson et al.

(10) Patent No.: US 9,175,575 B2
(45) Date of Patent: Nov. 3, 2015

(54) MODIFICATION OF TURBINE ENGINE SEAL ABRADABILITY

(75) Inventors: Stanley Frank Simpson, Simpsonville, SC (US); Gary Charles Liotta, Simpsonville, SC (US); Jeffrey Todd Knapp, Golden, CO (US)

(73) Assignee: General Electric Company, Schenectady, NY (US)

( * ) Notice: Subject to any disclaimer, the term of this patent is extended or adjusted under 35 U.S.C. 154(b) by 475 days.

(21) Appl. No.: 13/343,209

(22) Filed: Jan. 4, 2012

(65) Prior Publication Data

US 2013/0168927 A1 Jul. 4, 2013

(51) Int. Cl.
*F01D 11/00* (2006.01)
*F01D 11/12* (2006.01)

(52) U.S. Cl.
CPC ..... *F01D 11/001* (2013.01); *F01D 11/125* (2013.01); *F01D 11/12* (2013.01); *F01D 11/127* (2013.01); *F05D 2300/611* (2013.01); *Y10T 29/49297* (2015.01); *Y10T 428/24149* (2015.01)

(58) Field of Classification Search
CPC ..... F01D 11/125; F01D 11/127; Y10T 428/24149
See application file for complete search history.

(56) References Cited

U.S. PATENT DOCUMENTS

| | | | | |
|---|---|---|---|---|
| 4,659,289 | A | 4/1987 | Kalogeros | |
| 6,199,941 | B1 * | 3/2001 | Takahara et al. | 296/187.05 |
| 6,203,021 | B1 | 3/2001 | Wolfla et al. | |
| 6,235,370 | B1 * | 5/2001 | Merrill et al. | 428/116 |
| 6,610,416 | B2 | 8/2003 | Wallace et al. | |
| 7,500,824 | B2 | 3/2009 | Cheng et al. | |
| 2002/0158417 | A1 * | 10/2002 | Wallace et al. | 277/414 |
| 2004/0123573 | A1 * | 7/2004 | Ichikawa et al. | 55/523 |
| 2008/0274336 | A1 | 11/2008 | Merrill et al. | |

FOREIGN PATENT DOCUMENTS

| | | | |
|---|---|---|---|
| EP | 1780380 | A2 | 5/2007 |
| EP | 2317079 | A2 | 5/2011 |

OTHER PUBLICATIONS

Search Report and Written Opinion from EP Application No. 121983443.9 dated Mar. 21, 2013.

* cited by examiner

*Primary Examiner* — Mark Ruthkosky
*Assistant Examiner* — Julia L Rummel
(74) *Attorney, Agent, or Firm* — Dority & Manning, P.A.

(57) ABSTRACT

In one aspect, the present subject matter discloses a seal including a substrate material. The substrate material has a first portion having a first abradability and a second portion having a second abradability, the first abradability being different from the second abradability.

11 Claims, 4 Drawing Sheets

MODIFICATION OF TURBINE ENGINE SEAL ABRADABILITY

FIELD OF THE INVENTION

The present subject matter relates generally to turbines and, more particularly, to a turbine engine seal.

BACKGROUND OF THE INVENTION

Rotating labyrinth seals have a wide variety of uses and one such use is to effect sealing between plenums at different pressures in gas turbine engines. Such seals generally include two principal elements, i.e., a rotating seal and a static seal or shroud. The rotating seal, in cross section parallel to the axial length of the engine, frequently has rows of thin tooth-like projections extending radially from a relatively thicker base toward the static seal or shroud. The static seal or shroud is normally formed from a thin honeycomb ribbon configuration. These principal elements are generally situated circumferentially about the axial length of the engine and are positioned with a small radial gap therebetween to permit assembly of the rotating and static components. The purpose of the labyrinth seal arrangement is to minimize gas path leakage out of the primary gas path and to segregate different stages of the compressor which are at different temperatures and pressures.

To a significant extent, engine efficiency depends upon minimizing this gas leakage around rotating components by controlling the gas flow to maximize interaction between the gas stream and the components in the primary gas path. The effectiveness of the turbine engine varies directly with the proportion of gas that impinges upon the blades of the rotating member. Closer tolerances between the rotating and static seals achieve greater efficiencies. The fabrication process to obtain these close tolerances is extremely costly and time-consuming.

When the gas turbine engine is operated, the elevated temperatures of operation cause the opposed static and rotating seals, such as those in the rotating labyrinth seals, to expand in a radial direction toward each other. The rotating labyrinth seals expand radially and rub into the shroud, creating frictional contact between the thin projections of the rotating seal and the shroud. During the rub, there is high thermal compression, with resultant high residual tensile stress after the rub. This frictional contact causes elevation of seal teeth temperatures in excess of 2,000° F. with resulting possible damage to one or both seal members. For example, rotating tips may crack and break off, significantly impairing the seal efficiency and operation of the engine.

The thin, honeycomb ribbon construction of the shroud is used to reduce the surface area on which the seal teeth rub while reducing the weight of the structure, and helps to minimize the heat transferred into the rotating seal, while also providing the required strength. In addition, the rotating labyrinth seal teeth tips are constructed so as to be thin, in order to thermally isolate them from the supporting base or shell structure. However, excessive heat from deep rubs (even into the honeycomb) during engine start-up and during engine excursions can damage the rotating knife edge seals, negatively affecting durability and engine efficiency and providing a leak path for the flow of gases. Furthermore, material transfer can occur which also degrades the seal characteristics. Cutting into even low-density honeycomb cells can still cause rotary seal tooth damage, leading to premature part retirement.

While much effort has been directed at improving the rotating structure of the seal arrangement, there is a continuous need for improved designs for rotating labyrinth seal structures including improvements directed to the static structure to increase both service life and engine operating efficiencies.

BRIEF DESCRIPTION OF THE INVENTION

Aspects and advantages of the invention will be set forth in part in the following description, or may be obvious from the description, or may be learned through practice of the invention.

In one aspect, the present subject matter discloses a seal including a substrate material. The substrate material has a first portion having a first abradability and a second portion having a second abradability, the first abradability being different from the second abradability.

In another aspect, the present subject matter discloses a turbine engine seal. The seal includes a section of substrate material. The section of substrate material has a first portion having a first abradability and a second portion having a second abradability, the first abradability being different from the second abradability.

In still another aspect, the present subject matter discloses a method for producing a seal. The method includes forming a seal from a substrate material. The seal includes a first portion having a first abradability and a second portion having a second abradability, the first abradability being different from the second abradability These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
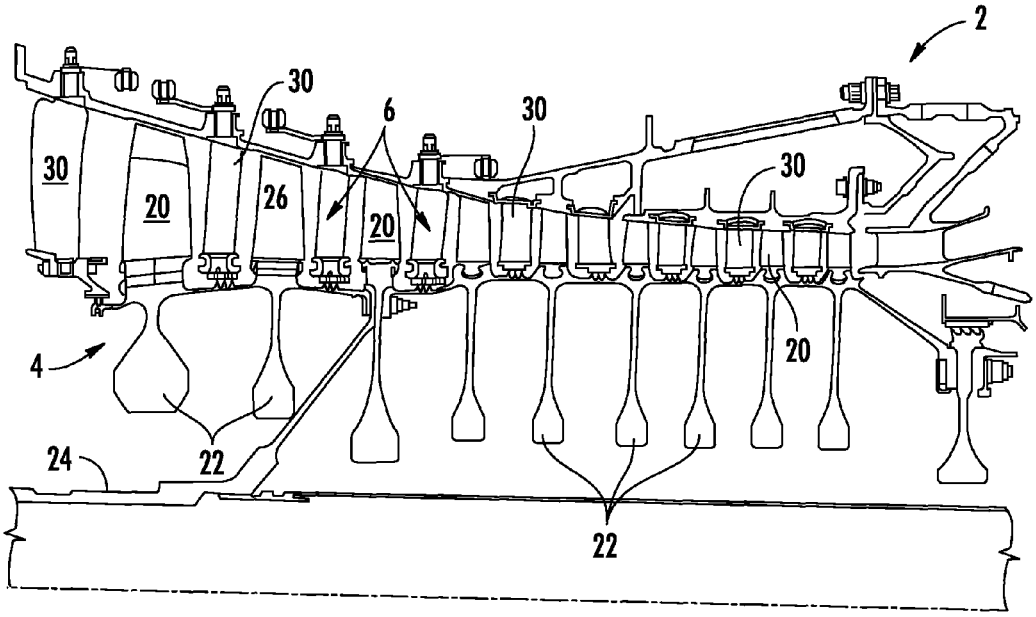
FIG. 1 illustrates a representation of a turbine compressor rotor and stator.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter discloses a turbine engine seal and method for producing the same. The seal includes a substrate material, which may, for example, be in the form of a ribbon. The substrate material can have a strengthened portion and/or a weakened portion allowing for abrasion where desired but otherwise minimizing wear in other regions where abrasion is not desired. Such a configuration reduces the opportunity for leakage in the seal zone. Even more broadly, the substrate material can be considered to have a first portion with a first strength and a second portion with a second strength, where the first strength is greater than the second strength. For example, one portion could simply have a "baseline" material strength and another portion could be either stronger or weaker than the "baseline".

The present disclosure overcomes the issues associated with a uniformly abradable surface. That is, if the entire surface is readily abradable, there is the risk of wearing out a part too quickly and/or having the part fail due to the overall weak structure. On the other hand, if the entire surface is not readily abradable, it can be difficult to achieve desired wear characteristics, especially at low wear and/or friction speeds. The present disclosure eliminates the need to choose between the two parameters by allowing for a desired level of abradability for each region of a given part.

Referring now to the Figures, where like parts have the same numbers, there is shown generally in FIG. 1 a segmented view of an axial flow compressor 2 of a typical engine having a compressor rotor 4 and stator 6. The compressor rotor of FIG. 1 includes a series of compressor blades 20 assembled to compressor disks 22, with the compressor disks assembled to a common shaft 24. The rotating labyrinth seals of the present invention are not shown in FIG. 1, but are located on the compressor rotor at 26, between compressor disks 22. The stator 6, which is stationary, includes a series of vanes 30 that axially direct the flow of air through the compressor as the rotating compressor blades 20 move and compress the air in an axial direction. The compressor blades 20 rotate between the compressor vanes 30 forming distinct stages of different pressures and temperatures. Associated with vanes 30, but positioned radially inward from the vanes and opposite the rotating labyrinth seals of the compressor rotor 4, are shrouds made of thin, honeycomb ribbons. While the methods of this disclosure are particularly adapted to the labyrinth seals, which are formed from a rotating labyrinth seal positioned on the rotor 4 between disks 22 and a stationary seal or shroud along stators 6 including thin honeycomb ribbon, other structures may be prepared using this method, if desired.

Figure 2:
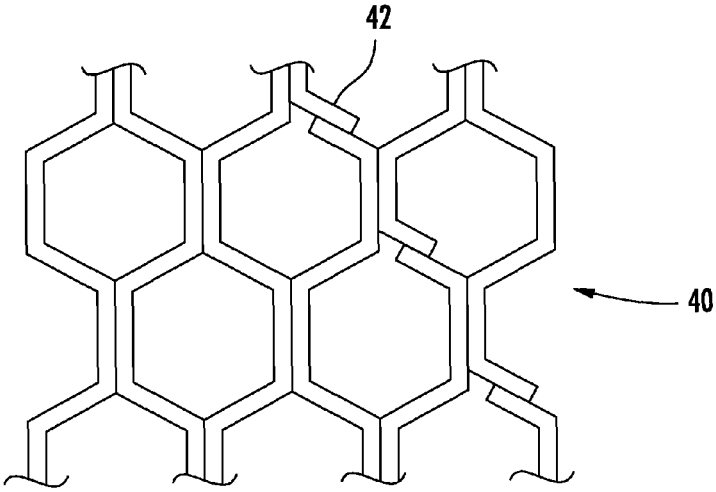
FIG. 2 illustrates a representation of a partial section of a honeycomb shroud.

Shown in FIG. 2 is a section of the generally cylindrical stationary seal or shroud 40 which is positioned in the stator 6 and includes a honeycomb structure 42 that is generally cylindrical and typically bonded to a backing ring (not shown in FIG. 2). One method for forming the honeycomb structure is by corrugating, stacking and joining thin ductile sheets of material such as nickel or nickel base superalloys. A braze alloy compatible with the ductile material sheet is placed at attachment points between the honeycomb structure and the backing ring. On cooling, the sheets, previously attached to each other by a joining process such as tack welding, are connected to the backing ring at attachment points 44 by brazing.

Figure 3:
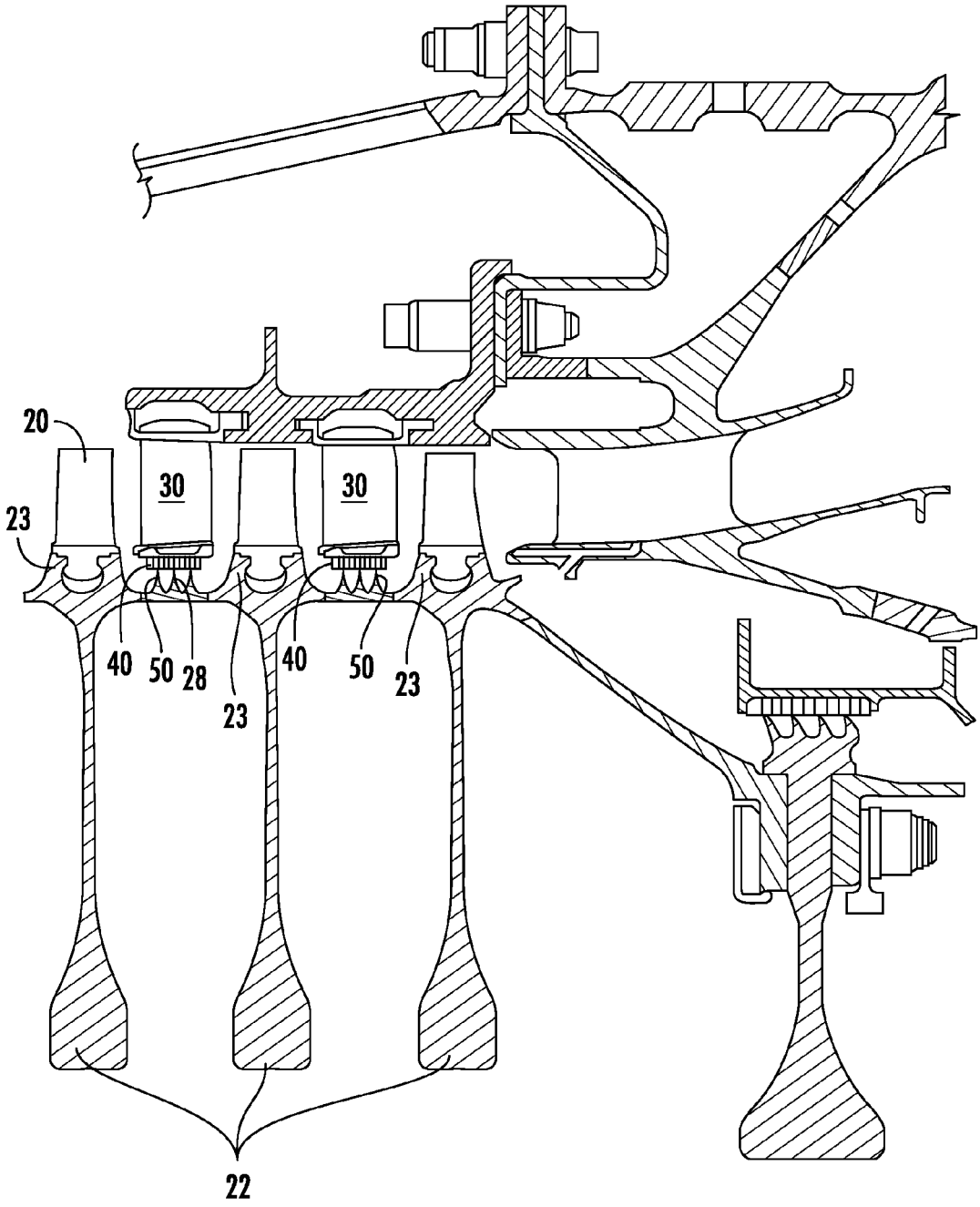
FIG. 3 illustrates a cross-section of a compressor showing the labyrinth seal teeth adjacent the honeycomb shroud.
Figure 4:
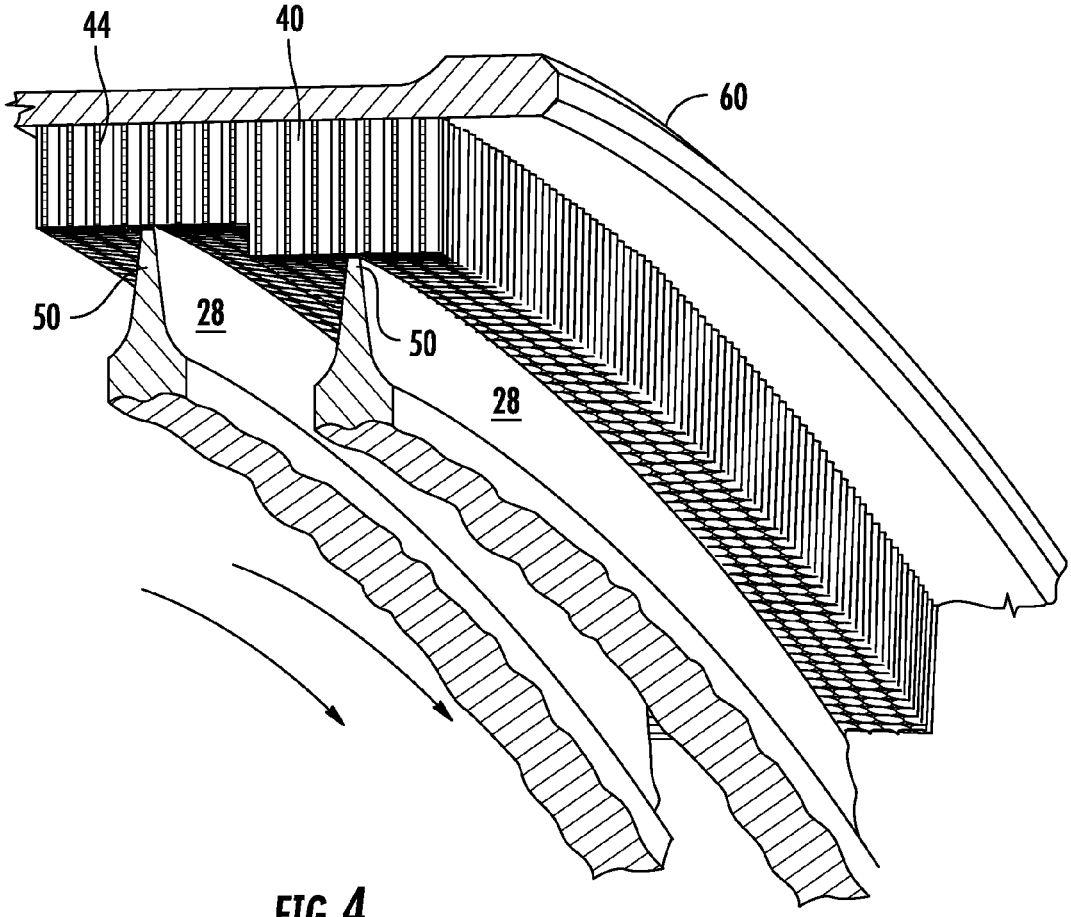
FIG. 4 illustrates a perspective view of a stepped labyrinth seal arrangement showing the teeth of the labyrinth seal adjacent the honeycomb shroud.

FIG. 3 is a cross-section of a compressor 2 that depicts honeycomb shrouds 40 assembled to compressor vanes 30. Adjacent to shrouds 40 are rotating labyrinth seals 28 positioned on the rotating portion of the compressor 2 between compressor disks 22. The rotating labyrinth seals 28 each have at least one tooth 50 projecting in an outward radial direction toward the shrouds 40. Compressor blades 20 are shown assembled to the outer circumference 23 of compressor disks 22, and positioned in the gas flow path between vanes 30. As is evident from FIG. 3, the radial expansion of the rotating portion of the compressor during engine operation will cause the teeth 50 of the rotating labyrinth seals 28 to bear against the honeycomb of the shroud, causing material to be removed from the shroud. FIG. 4 is a perspective view of the teeth of a rotating labyrinth seal 28 bearing against a honeycomb shroud 40 joined to a backing strip 60 of a stepped labyrinth seal. Other engine structure has been removed for clarity. The direction of rotation of teeth 50 is perpendicular to a line drawn from a vane through the blade teeth, that is, perpendicular to the projection of the blade teeth, or into the plane of the figure substantially in the direction of the arrows. As can be seen, it is desirable for the material from the shroud 40 to be removed in the form of small frangible particles rather than by melting, which requires more energy for removal, thereby heating teeth 50.

While the foregoing applications refer to the labyrinth seal used in the compressor portion of the gas turbine engine, it will be understood that a similar mechanical design for a labyrinth seal arrangement is used in the turbine or hot portion of the gas turbine engine to separate and isolate the various stages of the turbine sections from one another. The materials used in the hot section are different, utilizing nickel-base superalloys rather than titanium-base alloys, as the nickel-base superalloys have been adapted to survive at the high temperatures and severe environments of the turbine section of the engine.

The present disclosure provides for a preferentially abradable seal, such as a honeycomb seal, in which distinct regions of differing abradability are present. The preferentially abradable honeycomb seal described herein allows for greater control over the wear characteristics of the honeycomb. For example, a preferential wear shape can be achieved or more wear across a part can be promoted in a desired location. Localized wear resistance can simultaneously be promoted in order to limit wear of particular part locations.

Figure 5:
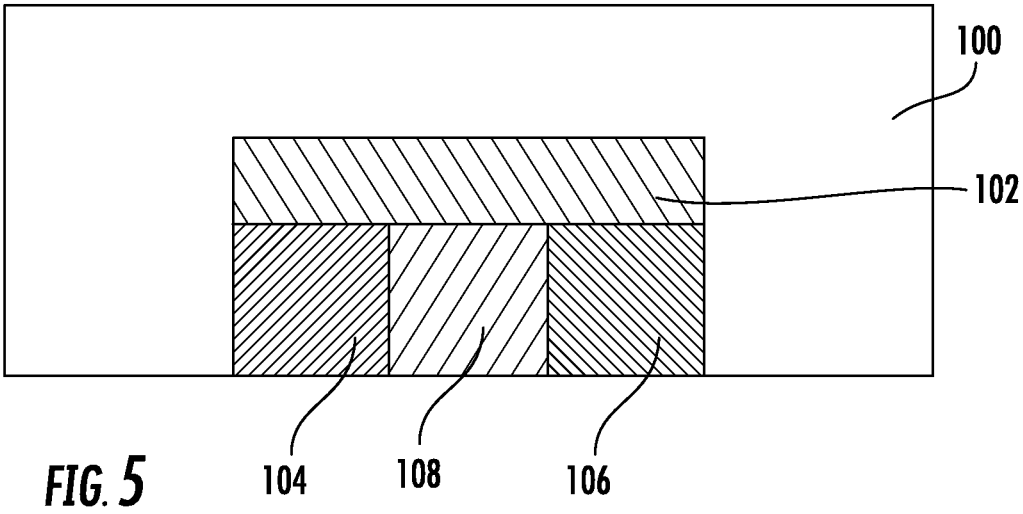
FIG. 5 illustrates a honeycomb structure.

For example, referring to FIG. 5, a metal part 100 is illustrated with honeycomb structure 102. The honeycomb structure includes two locally strengthened regions 104, 106 and a locally weakened region 108 positioned therebetween. In this regard, any suitable mechanism for creating preferential abrasion can be utilized in connection with the present disclosure including physical or chemical mechanisms. Mechanisms for creating preferential abrasion can involve the selective use of positive and/or negative mechanisms of promoting abrasion at chosen locations within the part in question. Positive mechanisms of promoting abrasion can include surface grooving, selective etching, ion implantation and/or diffusion, aluminiding, or the like, that would weaken a selected area, thus making it easier for the selected region to be abraded.

For instance, the method of the present disclosure can be performed by exposing the ductile material forming the honeycomb, for example, ribbon material, to a light element such as aluminum, nitrogen, hydrogen or boron at high temperatures to allow the light element to diffuse into the surface of the honeycomb and alter the strength characteristics of the honeycomb by forming a brittle phase that can be more easily machined and abraded. It is known that aluminide coatings such as titanium aluminide (TiAl) and nickel aluminide (NiAl) can have brittle characteristics in a range of temperatures below the Ductile-Brittle Transition Temperature (DBTT), and that a boronized surface can reduce the ductility of high-strength nickel based sheet metal by embrittling it. Although boron is a light element which can diffuse away quickly in hot sections of the turbine engine in which the temperatures in the region of the seal or shroud can approach 1800° F., it can be utilized in the cold sections of the engine such as the compressor or in non-flow path areas of the turbine where the maximum temperatures reached are generally in a range below about 1300° F. (about 700° C.). At these operating temperatures, further diffusion of aluminum or even a light element such as boron is minimal, and the diffusion coating will not continue to grow into the substrate base material.

Thus, it is possible to grow a diffusion coating into a thin substrate to provide a thin, frangible surface layer, while maintaining a ductile base material underlying the thin surface layer. In higher temperature applications, such as combustor regions and turbine sections, braze alloys for the honeycomb can have solidus temperatures above about 1900° F. For high temperature applications, the coating can be applied to the honeycomb at a temperature lower than the lowest solidus temperature braze alloy used in the assembly of the part or component, typically lower by about 25-50° F. As an example, a low pressure turbine vane uses a braze alloy with a solidus temperature of about 2100° F. The honeycomb was coated in accordance with the present invention at a temperature in the range of about 1925-1975° F. for about 2-6 hours.

The coating may be applied by a vapor phase deposition process, by a pack-process, by an activated aluminum-containing tape, referred to as CODAL tape, or by slurry, typically after the honeycomb material has been formed. The coating is then diffused into the base material forming the honeycomb. The regions of attachment of the honeycomb to the backing plate may be masked, if desired, to protect these regions from exposure to the lightweight elements in order to facilitate brazing. After the coating is applied by exposing the substrate base material sheet to the lightweight element promoting the formation of the diffusion coating at elevated temperature, the masking material is removed so that brazing of the honeycomb to the backplate can be accomplished in a conventional manner. It is also possible to apply the coating after brazing the honeycomb to the backing structure. By exposing the honeycomb seal to the diffusible element at an elevated temperature, the easily diffusible element is diffused into the substrate material to an effective depth to form a frangible coating extending to the effective depth overlying the ductile substrate, while maintaining the effective environmental resistance of the honeycomb seal.

As previously noted, the coating may be formed by any of several methods. One method for forming an aluminide coating is vapor phase aluminiding (VPA) which can be accomplished by a pack process or by an over the pack process. In a pack process, the substrate is placed into a powder that includes aluminum as well as an inert powder. However, other lightweight powders may be substituted for aluminum to achieve a different type of frangible coating. In one form, the powder can be packed into the cells of the honeycomb prior to heating. The brazed areas may be masked, if desired, to minimize the exposure of these areas to the lightweight element such as aluminum. In another form, the substrate sheets may be packed into the powder with appropriate masking prior to formation of the honeycomb structure as previously discussed. An activator is also included in the powder to enhance the exposure of the substrate to the lightweight element. The packed substrate is heated to a predetermined elevated temperature for a preselected time to allow the lightweight element to diffuse into the substrate a predetermined distance, forming a coating having a thickness corresponding to the predetermined distance. The depth of diffusion of the element into the substrate is determined by the temperature of exposure and time at temperature.

Another VPA method for growing a diffusion coating into the substrate is by an over-the-pack process. The mechanism of formation in the over-the-pack process of the diffusion coating by growth into the substrate is similar to the mechanism in the pack process. The major difference in the over-the-pack process is that the substrate is suspended over the powders rather than being in direct physical contact therewith. The gaseous, lightweight elements form a gas phase on heating which flows over the suspended substrate. The lightweight elements flow over and are deposited onto the substrate surface and subsequently diffuse into the substrate surface.

Referring again to FIG. 5, negative mechanisms for promoting abrasion actually would provide reinforcement of a given area. Any suitable mechanism for reinforcement can be utilized, including reinforcement coatings, ion implantation, heat treatment and/or annealing, densification, or the like. Such mechanisms reduce the abradability and can increase the wear resistance of a given location.

Further, it is possible to make one region preferentially abradable, while making, e.g., adjoining areas stronger and more abrasion resistant. In this regard, at least one portion of the seal can be masked such that the other portion of the seal is not subjected to the positive, negative, or both treatments described herein. For instance, a mask device that is extendable into the honeycomb so as to block one or more chosen interior walls from treatment can be utilized.

The provision of distinct zones/regions of a given level of abradability can allow for tighter cold clearances with adjoining components. Such abrasion control can be of particular usefulness in blade-tip sealing environments, allowing for abrasion where desired, but otherwise minimizing wear in immediately adjacent regions, thereby reducing the opportunity for leakage in the seal zone. Additionally, the differentially abradable seals described herein could be extended to other seal systems beyond honeycomb-type seals.

A further advantage of the method described herein is that the relatively stronger area acts as a support when the teeth are cutting into the abradable area. As an example, in FIG. 5, regions 104 and 106, the strengthened regions, can act as supports to make the cut into region 108 more well-defined. Such enhanced definition of the cut leads ultimately to a better sealing structure.

Figure 6:
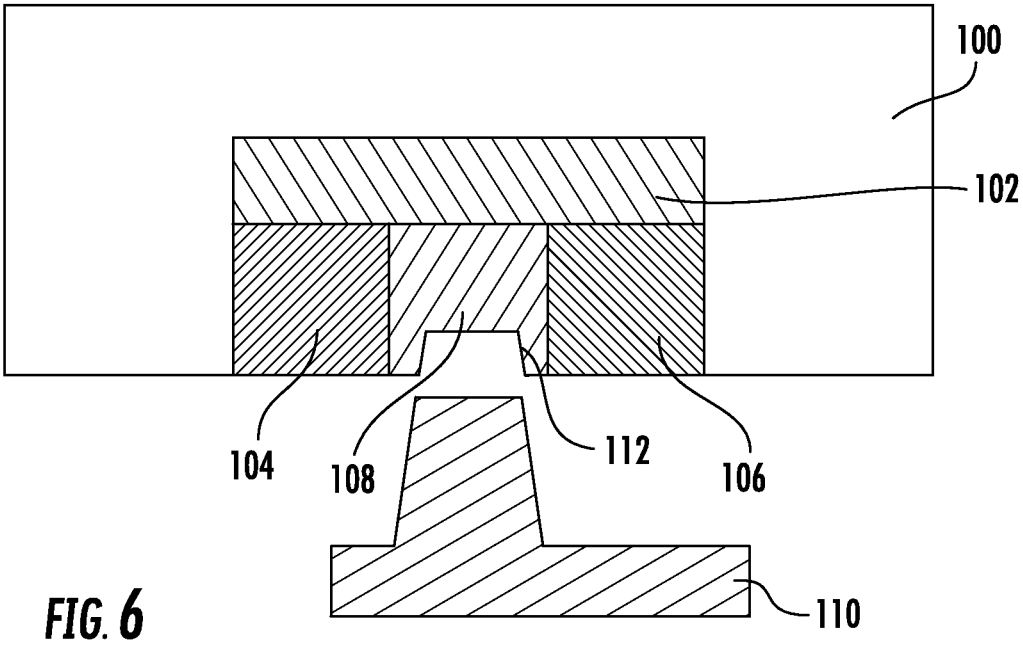
FIG. 6 illustrates a honeycomb structure and cutting surface.

Turning to FIG. 6, the honeycomb structure 102 includes two locally strengthened regions 104, 106 and a locally weakened region 108 positioned therebetween, with cutting surface 110 adjacent thereto. Locally weakened region 108 gives way more readily when a seal cut is initiated by cutting surface 110, and cleaner sealing edges 112 are present following the seal cut due to minimal tearing and/or shredding. Cutting surface 110 also experiences minimal damage from the slow speed rub. The strength differential of the regions results in a cleaner cut and more efficient sealing.

The thickness of the honeycomb ribbon substrate forming the shroud is generally from about 0.001 inch to about 0.005 inch, typically about 0.003 inch. Honeycomb cell width is typically about 1/16" (0.063"), 1/32" (0.032") or 1/8 inch (0.125"). The honeycomb cell height is between about 1/4" (0.25") to about 1/2" (0.5").

While the depth of the rub may be as great as 0.090 inch, rub depth is typically about 0.015 inch to about 0.020 inch for 360° of travel, with about 0.060 inch depth considered severe.

At least one weakened portion of the seal can have a depth of at least about 10 percent of the ribbon thickness. In certain embodiments, a weakened portion of the seal can have a depth of at least about 25 percent of the ribbon thickness. In still other embodiments, a weakened portion of the seal can have a depth of at least about 50 percent of the ribbon thickness.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine engine seal assembly comprising:

a backing; and a turbine engine seal comprising a honeycomb structure made up of ribbons of ductile material, the honeycomb structure comprising a base substrate region that is attached to the backing and a surface substrate region positioned atop and coextensive with the base substrate region, the base substrate region defining a first abradability; and the surface substrate region further defining center and side regions, the side regions positioned alongside and adjacent the center region, the center region defining a second abradability and the side regions defining a third abradability;

wherein the center region has been locally weakened by a local weakening treatment and the side regions have been locally strengthened by a local strengthening treatment such that the first abradability of the base substrate region is less than the second abradability of the center region, and the first abradability of the base region is greater than the third abradability of the side regions.

2. The turbine engine seal assembly of claim 1, wherein the center region has been locally weakened by applying a local weakening treatment configured to increase brittleness.

3. The turbine engine seal assembly of claim 1, wherein the local weakening treatment creates a weakened region that extends through about 10 percent or more of the total thickness of the ribbon making up the center region.

4. The turbine engine seal assembly of claim 1, wherein the local weakening treatment creates a weakened region that extends through about 25 percent or more of the total thickness of the ribbon making up the center region.

5. The turbine engine seal assembly of claim 1, wherein the local weakening treatment creates a weakened region that extends through about 50 percent or more of the total thickness of the ribbon making up the center region.

6. The turbine engine seal assembly of claim 1, wherein the local weakening treatment is a chemical treatment.

7. The turbine engine seal assembly of claim 6, wherein the chemical treatment includes exposing the center region to a light element at high temperatures to allow the light element to diffuse into a surface of the center region.

8. The turbine engine seal assembly of claim 1, wherein the local weakening treatment comprises one or more of surface grooving, selective etching, ion implantation or diffusion, or aluminiding.

9. The turbine engine seal assembly of claim 1, wherein the local weakening treatment involves exposing the center region to a light element at high temperatures to allow the light element to diffuse into the surface of the center region.

10. The turbine engine seal assembly of claim 9, wherein the light element comprises one or more of aluminum, nitrogen, hydrogen, and boron.

11. The turbine engine seal assembly of claim 9, wherein the side regions are masked while the local weakening treatment is applied to the center region such that the side regions are not subjected to the local weakening treatment.

* * * * *